US006796539B2

(12) United States Patent
Tilton

(10) Patent No.: US 6,796,539 B2
(45) Date of Patent: Sep. 28, 2004

(54) APPARATUS FOR FASTENING CONTAINERS FOR PLANTS AND STORAGE ONTO BALUSTERS

(76) Inventor: Donald Tilton, 51 Springfield Cir., Merrimack, NH (US) 03054

( * ) Notice: Subject to any disclaimer, the term of this patent is extended or adjusted under 35 U.S.C. 154(b) by 0 days.

(21) Appl. No.: 10/211,837

(22) Filed: Aug. 3, 2002

(65) Prior Publication Data

US 2003/0024161 A1 Feb. 6, 2003

Related U.S. Application Data

(60) Provisional application No. 60/310,000, filed on Aug. 6, 2001.

(51) Int. Cl.[7] ..... A47B 96/06
(52) U.S. Cl. ..... 248/231.61
(58) Field of Search ..... 248/231.61, 231.41, 248/313, 316.6; 211/86.01, 88.03; 47/65.5, 66.1; 52/11; 119/51.5, 61, 74, 477, 454

(56) References Cited

U.S. PATENT DOCUMENTS 2,183,332 A * 12/1939 Haritos
2,830,781 A * 4/1958 Coulter
3,627,244 A * 12/1971 Nicholas ..... 248/103
4,423,556 A * 1/1984 DiVelez ..... 33/180 R
5,269,095 A 12/1993 Helfman et al.
5,470,037 A * 11/1995 Willis ..... 248/125.9
5,524,856 A * 6/1996 Neely et al. ..... 248/231.61
5,855,184 A * 1/1999 Eichler et al. ..... 119/51.5
5,899,420 A * 5/1999 Gerardi ..... 248/146
5,924,615 A * 7/1999 McGarrah ..... 224/404
6,209,260 B1 * 4/2001 Surette ..... 47/65
6,435,134 B1 * 8/2002 Ho ..... 119/72

FOREIGN PATENT DOCUMENTS

DE 3506407 A1 * 8/1986 ..... A47G/7/02
DE 19536968 A1 * 4/1997 ..... A47H/27/00

* cited by examiner

*Primary Examiner*—Gwendolyn Baxter
(74) *Attorney, Agent, or Firm*—Joseph E. Funk

(57) ABSTRACT

The disclosure describes a fastening means for attaching containers to the side of balusters of railings of porches, balconies and stairways, and the containers are used to hold plants and to store items. The containers are mounted to the side of the balusters furthest from the porches, balconies and stairways and do not take up any space on the porches, balconies and stairways. Heavier containers have a support lip that rests on the floor of the porches and balconies to support the heavier weight while the fastening means hold the container firmly against the balusters. The fastening means comprises a threaded member that extends from the rear of a container and through the balusters, and a cross bar and knurled knob with nut turn onto the threaded member to pinch the balusters, thereby creating a frictional force that holds the containers to the balusters.

2 Claims, 6 Drawing Sheets

APPARATUS FOR FASTENING CONTAINERS FOR PLANTS AND STORAGE ONTO BALUSTERS

RELATED APPLICATION

This application claims the benefit of co-pending Provisional patent application Ser. No. 60/310,000 filed Aug. 6, 2001.

FIELD OF THE INVENTION

This invention relates to fastening means for attaching containers to balusters used in places such as on porches, balconies and stairways, and the containers may be used to hold plants or to store items.

BACKGROUND OF THE INVENTION

In the prior art balusters have been not been used for any purposes except for decorative purposes, to provide support to railings to which they are attached, and to help prevent people from falling past a railing supported by the balusters. These purposes for balusters are important but limit the use of space around the balusters.

In urban environments some high rise apartments have small porches or balconies that are used to sit outside, but there is little or no space to store chair cushions, magazines or other things used on such small porches or balconies. There is also little space to place flower planters. One approach to solving this space problem is to mount planters on top of or alongside a railing, as for example on the balconies of high rise condominiums, on the decks of houses, on the decks of above-ground pools, and so on. An example is taught in U.S. Pat. No. 5,269,095 issued Dec. 14, 1993. However, fastening of this type obstructs with the ability to use a railing as a support for people to hold.

Thus there is a need in the prior art for means to utilize heretofore unused space to fasten planters and storage containers on porches, decks, balconies and stairs, whether in a high rise, houses, pools, or elsewhere.

SUMMARY OF THE INVENTION

The present invention meets the need in the prior art to provide means to utilize heretofore unused space to fasten planters and storage containers on porches, decks, balconies and stairs, whether in a high rise, houses, by a pool, or elsewhere. The novel fastening means is used for attaching such containers to the side of balusters of railings used in places such as porches, balconies and stairways, and the containers may be used to hold plants or to store items.

High rise apartments having small porches or balconies also have railings with balusters and the novel fastening means is used to attach planters and storage containers to the sides of the balusters, and preferably to the outside of the balusters, off the porch or balcony. Thus, the planters and storage containers may be fastened in a position and in a manner that takes up no space on the porch or balcony. In addition, the top of railings may still be utilized for their intended purpose of being used as a hand hold.

The fastening means attaches to the side of planters and containers and, when they are positioned on the outside of a railing, the fastening means extends through balusters and a clamping means is engaged to hold the planters and containers firmly against the balusters.

For heavier planters and containers a horizontal support lip is provided on one side or a bottom edge of the planter or container. The support lip sits on the edge of the floor of the deck or balcony and cooperates with the fastening means to attach the planter or container to the balusters.

DESCRIPTION OF THE DRAWINGS

The invention will be better understood upon reading the following Detailed Description in conjunction with the drawing in which.

DETAILED DESCRIPTION

Figure 1:
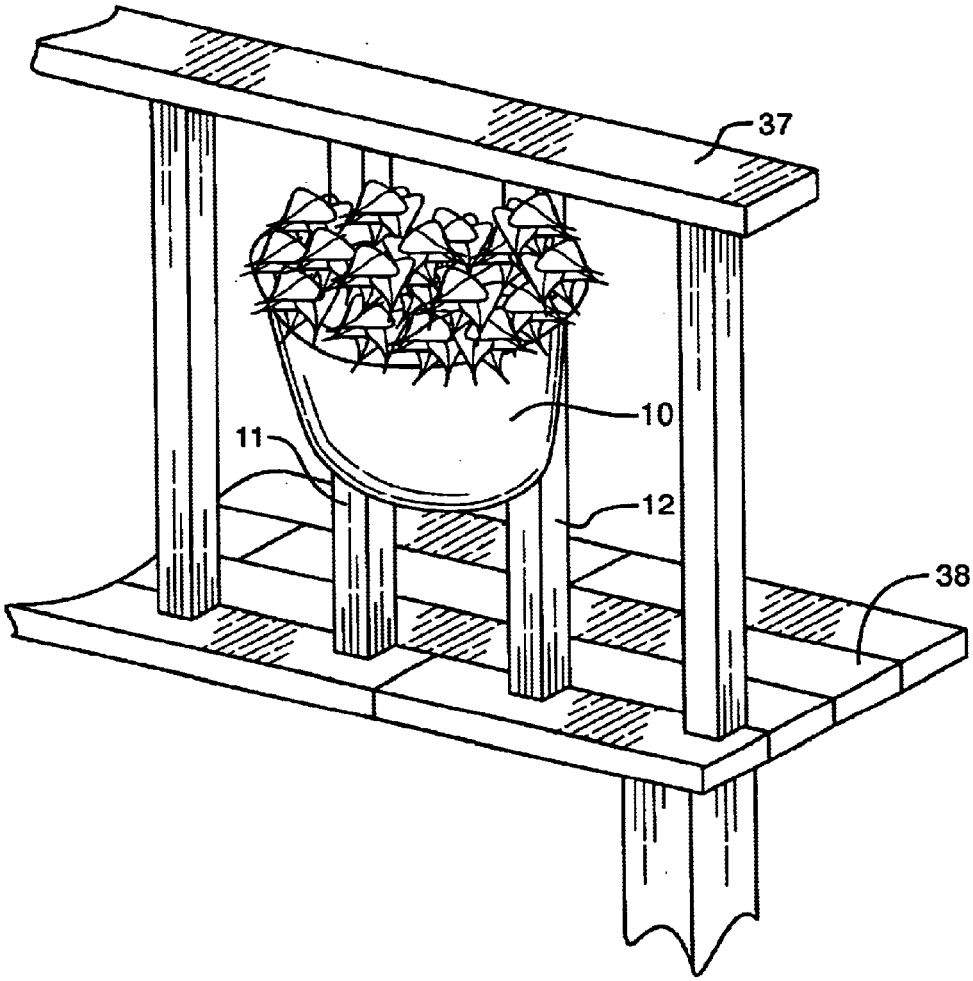
FIG. 1 is a front view of a planter equipped with the novel fastening means attached to balusters.

In FIG. 1 is shown a front view of a semi-circular container equipped with the novel fastening means (seen in FIG. 2) to be attached to balusters 11 and 12 that support railing 37 of a porch 38. In FIG. 1 and in the following description the container is identified as planter 10, but it may also have an open top or have a cover and be used for the purpose of storage such as shown in and described in greater detail with reference to FIGS. 7 and 8. The planter 10 may be made of any appropriate material such as metal, plastic, synthetic resin or wood. In addition, planter 10 can have any number of fanciful patterns molded or otherwise formed into its outer surface to enhance the aesthetical appearance of the planter.

It can be seen in FIG. 1 that planter 10 takes up no room up on the porch 38 while providing a decorative appearance and performing its intended purpose. While planter 10 is shown mounted to the balusters 11, 12 of a deck 38, it also may be mounted to balusters of a balcony of a high rise apartment, or to the balusters on the side of a stairway, both inside and outside.

Figure 5:
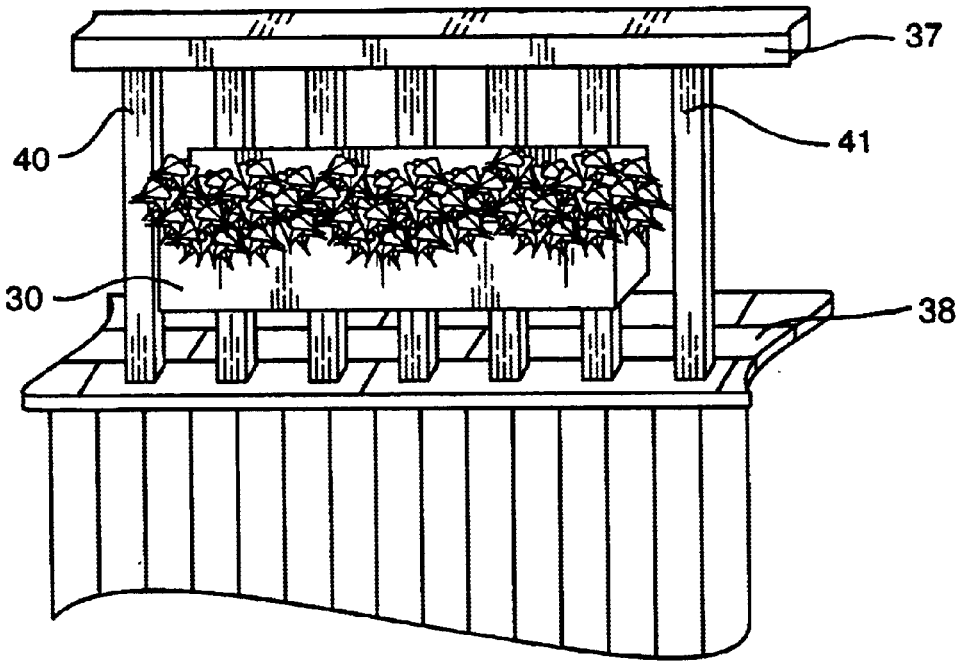
FIG. 5 shows a front view of a larger planter attached to porch balusters using a plurality of the novel fastening means.
Figure 6:
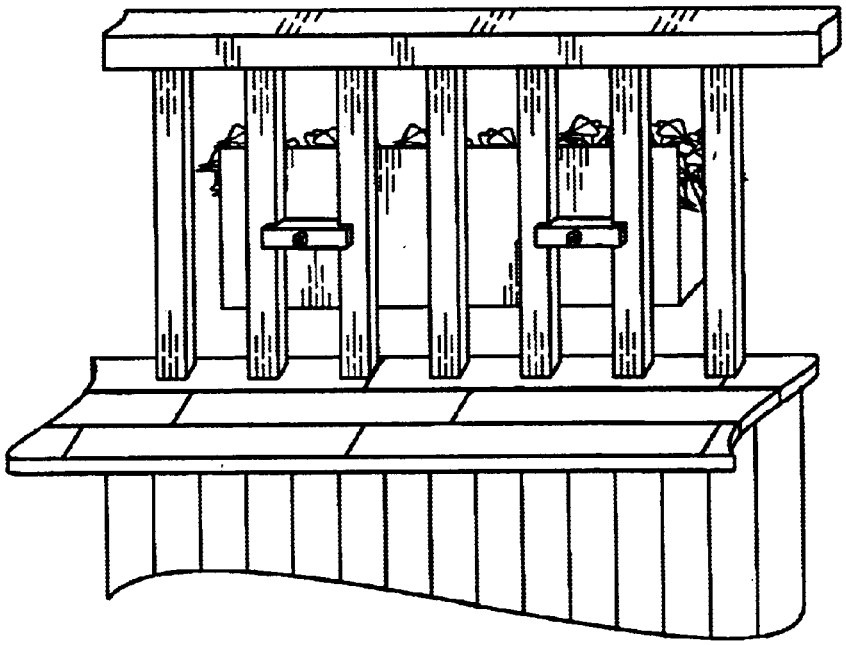
FIG. 6 shows a rear view of the larger planter in FIG. 5 attached to the porch balusters using a plurality of the novel fastening means.

In addition, planter 10 may be any desired shape. While the planter 10 shown in FIG. 1 is preferably big enough to span at least two balusters 11 and 12, more balusters may be spanned as shown in FIGS. 5 and 6. Further, a planter 10 may be smaller and not span two balusters, but a portion of fastening means will be seen as described in more detail with reference to FIG. 6.

Figure 2:
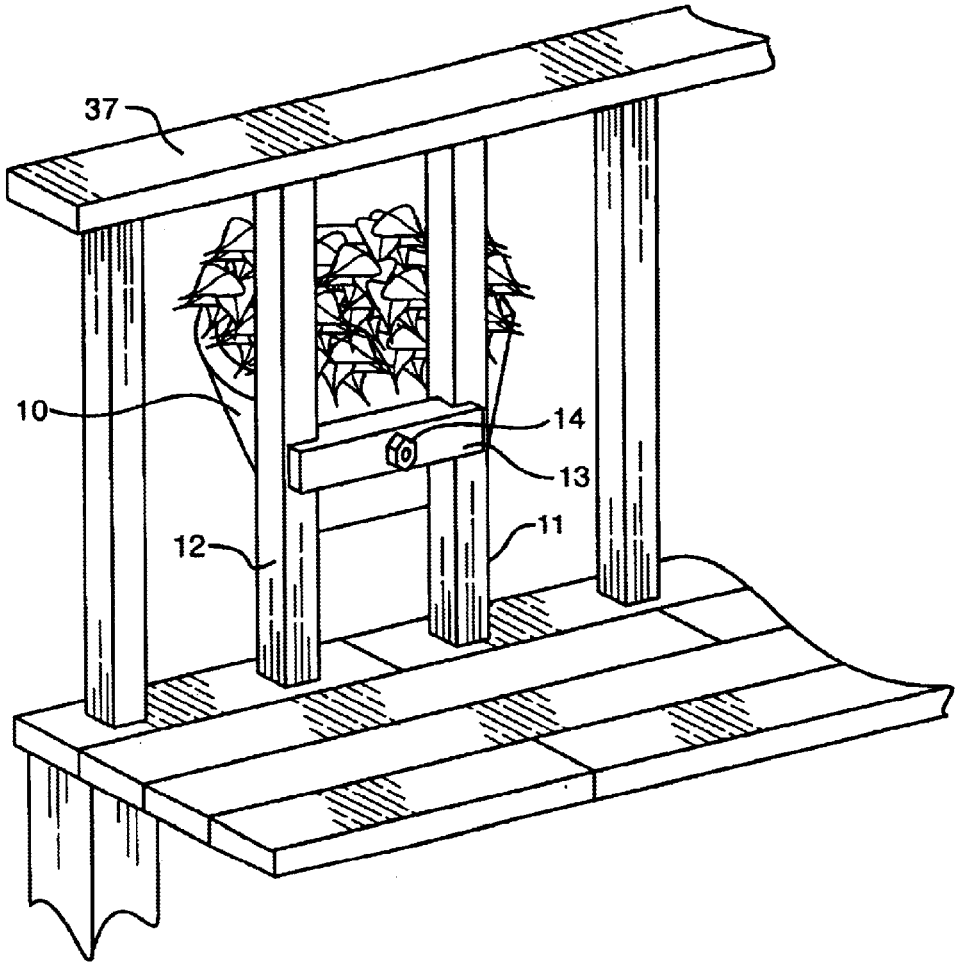
FIG. 2 is a rear view of the planter in FIG. 1 showing the novel fastening means attaching the planters to the porch balusters.

FIG. 2 is a rear view of the planter 10 in FIG. 1 showing the novel fastening means attaching the planter 10 to the porch balusters 11 and 12. The fastening means, as shown in FIG. 2, includes a cross bar member 13 and a knurled tightening knob 14 which is knob with a threaded hole through its center area. A nut (not shown) may also be insert into the center of knob 14 in a recessed manner for this purpose. In fastening planter 10 to balusters 11 and 12, cross bar 13 is placed across the opposite side of balusters 11 and 12 from planter 10 as shown, and fastening means 14 is tightened by turning to squeeze planter 10 and bar 13 against opposite sides of the balusters 11 and 12.

Member 13 spans balusters 11 and 12 and knob 14 screws onto a threaded screw that extends from the rear of planter 10 and between balusters 11 and 12. Knob 14 preferably has a large enough diameter to permit the proper tightening force to be created when hand tightening for the fastening means to work properly. A wide knob 14 serves to spread force over bar 13 in a manner known in the art. Alternatively, knob 14 need not be provided but a flat washer and nut that is turned onto the screw extending from planter 10, but this is not as aesthetically pleasing visually.

As knob 14 is tightened a force is created that holds planter 10 and cross bar member 13 tightly against opposite sides of balusters 11 and 12 and a frictional force is created thereby such that planter 10 stays in the fastening position shown in FIGS. 1 and 2. Further details of the fastening means are shown in and described with reference to FIG. 3. Extra friction may be created by molding small, raised ridges on the surface of cross bar 13 that contact balusters 11 and 12 and can dig into wooden balusters. Alternatively, a piece of tape may be attached to the surface of bar 13 that contacts balusters 11 and 12, and the tape has a sand like surface, similar to tape strips that are attached to concrete stairs so people do not slip and fall. The latter is more required for metal balusters.

Figure 3:
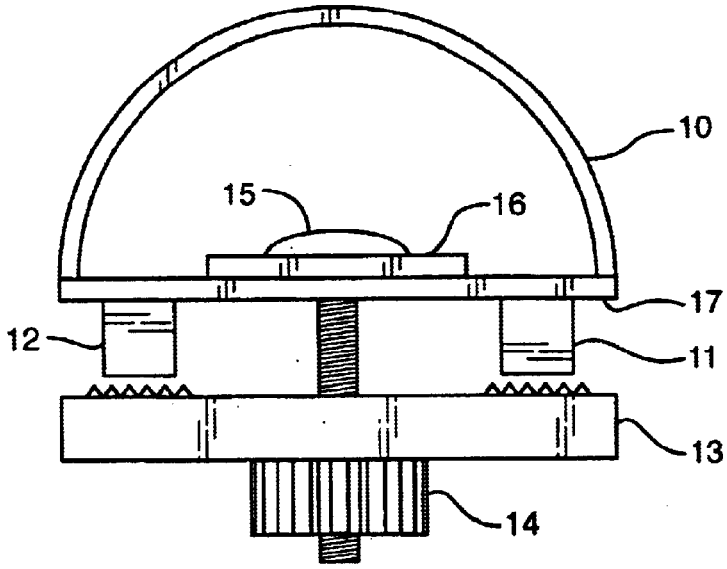
FIG. 3 is a top view of the planter of FIG. 1 showing how the novel fastening means attaches the planter to the porch balusters.

In FIG. 3 is shown a top view of planter 10 of FIG. 1 showing further details of the novel fastening means and how it is used to attach planter 10 to balusters 11 and 12. Through the flat, back wall of planter 10 is a hole having a diameter only slightly larger than the threaded shaft (not shown) of a wide headed screw 15. A wide, fender washer 16, or a flat piece of metal or other material, is first placed onto the threaded shaft of screw 15 until it is under the head of the screw. Washer 16 protects the rear surface 17 of planter 10 by providing strain relief in a manner well known in the art. The threaded shaft of screw 15 is then inserted through the hole through the back wall of planter 10 from the inside of planter 10. When the threaded shaft extends past balusters 11 and 12 a hole through the center of cross bar member 13 is inserted onto the threaded shaft of screw 15. As described in the previous paragraph cross bar 13 has small, raised elements on the surface of cross bar 13 that contact balusters 11 and 12, as shown by the ridged surface in FIG. 3, or has tape with a sand paper like, rough surface. Knurled knob 14 with a threaded nut insert is screwed onto the end of the threaded shaft of screw 15. As knob 14 is turned tight planter 10 and cross bar 13 are forced against opposite sides of balusters 11 and 12 creating a pinching force such that planter 10 stays in the fastening position shown in FIGS. 1 and 2. In addition, additional pieces of tape with a sand paper like, rough surface may be provided and attached to the rear side of planter 10 so as to contact balusters 11 and 12 when planter 10 is mounted on the balusters.

Figure 4:
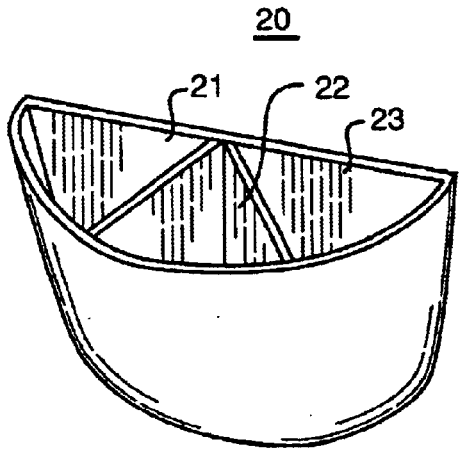
FIG. 4 shows inserts that are placed in the top of the planter to grow plants.

FIG. 4 shows cup like inserts 21, 22, 23 (not seen in FIG. 1) that hold dirt and plants or flowers, or plastic plants or flowers that are be placed in the open top of a planter 10. The insert(s) either hook onto the top edge of planter 10, or rest on molded ledges (not shown) on the inside of planter 10. The inserts shown are typically molded of plastic, formed as a single piece 20 and partitioned into multiple, triangular cup shaped segments 21, 22 and 23. When inserted into planter 10 piece 20 is bent to the shape shown in FIG. 4. Alternately, there may be a number of separate, discrete, cup shaped inserts. While there are three pie shaped inserts shown in FIG. 4, their actual shape is determined by the shape of planter 10. In addition, there may be a plurality of inserts as shown in FIG. 4, or there may be a single insert.

FIG. 5 shows a front view of a larger, rectangular shaped planter 30 attached to porch balusters. This larger planter 30 spans a plurality of balusters as shown. There may or may not be cup like inserts in this planter. To attach such a larger planter or storage container to the balusters a plurality of the novel fastening means are utilized. They are not shown in FIG. 5 but are shown in and described with reference to FIG. 6.

FIG. 6 shows a rear view of the larger planter 30 in FIG. 5 attached to the porch balusters using a plurality of the novel fastening means. In this example two fastening means of the type shown in and described with reference to FIG. 3 are utilized, but more than two may also be utilized. As may be appreciated, due to the larger size of planter 30 a single fastening bar 13 is insufficient to mount planter 30 to the balusters. As shown in FIG. 6, multiple bars 13 and fastener elements 14 are utilized. While two bars 13 and fastener means 14 are shown, more than two may be used, if required or as desired. They are the same as those shown in and described with reference to FIG. 4 so the description is nor repeated here for the sake of brevity.

Figure 7:
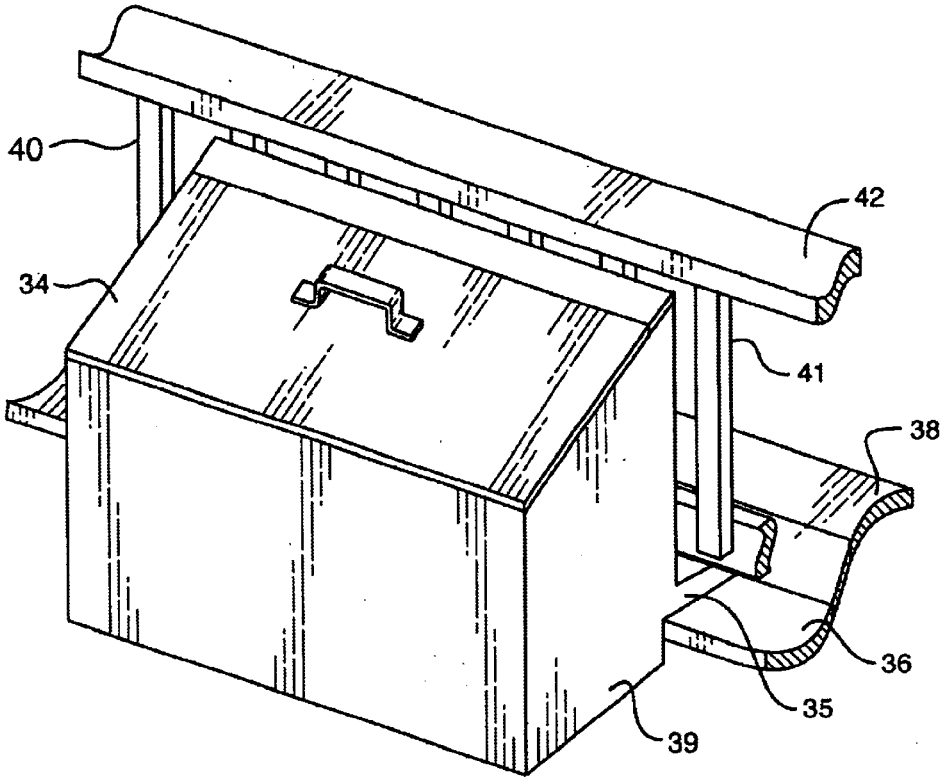
FIG. 7 shows a front view of a storage container attached to porch balusters as not to take space up on a porch or balcony.

In FIG. 7 is shown a front view of a storage container 39 with lid 34 attached to porch balusters as not to take space up on a porch or balcony. Only two balusters 40 and 41 are shown but there are more balusters, not shown, between these two balusters. Container 39 may be deep, in the order of eighteen to twenty-four inches, several feet wide, and lid 34 is provided to seal the inside of container 39 from the elements. Lid 34 is sloped to facilitate the run off of rain. This enlarged storage container can be used to store larger items, such as porch furniture cushions that are often removed and stored when not in use to protect them from rain or prolonged exposure to the sun. By fastening storage container 39 on the outside of the balusters so it takes up no space on a porch or balcony, storage space is effectively created since the stored items are not on the normal, functional area of the porch or balcony, and are not inside a house or apartment where storage space may be or is at a minimum.

Figure 8:
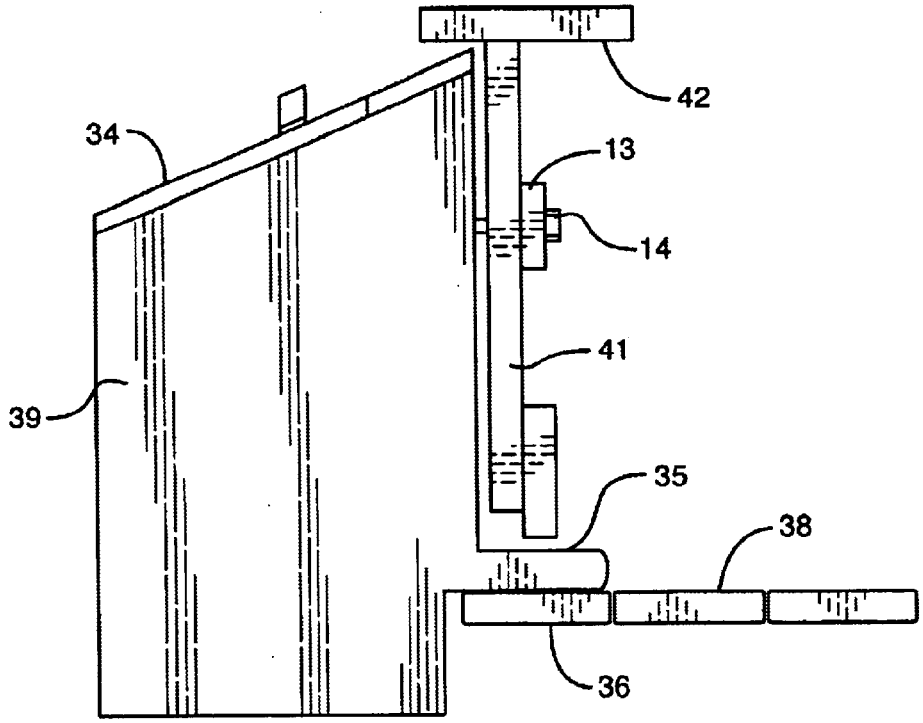
FIG. 8 shows a side view of the storage container of FIG. 7 attached to the porch balusters.

Storage container 39 maybe deep enough that its bottom surface will sit on the outer edge 36 of porch 38. This is not shown in FIGS. 7 and 8. Preferably, container 39 may be provided with an extending support member 35 that sits on the edge 36 of porch 38, such as shown in FIGS. 7 and 8, when the storage container 39 is attached to the balusters. The support member 35 may alternatively be co-planar with the bottom surface of container 39 and extend in the direction of the balusters to rest on the top, outer surface 36 of the porch floor 38 to support the weight of container 39 and its contents thereon. Support member 35 is sturdy enough to support the weight of storage container 39 when it has a fair amount of weight therein.

With a support member 35 on a storage container 39 the novel fastening means do not support all the weight of the container. Rather, the weight of container 39 and its contents is primarily supported by the support member 35 and the fastening means are used to hold container 39 against the balusters so the container does not fall off the porch or balcony.

The support member 35, no matter where located, preferably extends along the length of container 39 but a plurality of shorter support members, spaced along the length of container 39, may also be utilized. While the support member 35 in FIGS. 7 and 8 is shown as being formed as an integral part of storage container 39, it may be a separate part that is attached to the rear of container 39 in an adjustable manner to facilitate fastening container 39 on balusters of different heights, and to facilitate fastening container 39 at different heights.

FIG. 8 shows a side view of the storage container of FIG. 7 attached to the porch balusters and supported on the edge 36 of deck 38 by support member 35. As previously described, storage container 39 may be several feet wide and will span across a number of balusters 41 that are not shown in FIG. 8. Accordingly, similar to the wide planter shown in FIGS. 5 and 6, a plurality of fastening means of the type shown in and described with reference to FIG. 3 are utilized. The number of fastening means is basically dependent upon the weight of storage container 39 and its contents. The fastening means are the same as those shown and described with reference to FIG. 4 so the description is nor repeated here for the sake of brevity.

In an alternative embodiment of the invention, a container having a similar or different shape to planter 10 in FIG. 1, may be mounted on balusters 11 and 12 to face the porch side of the balusters 11 and 12. With no insert(s) placed into the container it may be used to place items such as, but not limited to, magazines and newspapers. It may also be used as a trash basket.

While what is described herein is the preferred embodiment of the invention and some alternative embodiments, it will be understood by those skilled in the art that numerous changes may be made without departing from the spirit and scope of the invention.

What is claimed is:

1. A fastening means for attaching a container to the side of balusters on a porch, balcony or stairs, said fastening means comprising:

a support member that is attached to the container, the support member resting on the porch, balcony or stairs having the balusters to support the weight of the container;

a threaded member attached to one side of the container and passing between the balusters when the container is positioned against the balusters;

an elongated member with a hole therethrough on the opposite side of the balusters from the container and spanning at least two adjacent balusters, the threaded member passing through the hole when the container is positioned against the balusters and cooperating with the elongated member to draw the container tightly against the balusters; and a knurled knob having a nut that is mounted in the knob, the nut being turned onto the threaded member as it extends through the balusters and the hole through the elongated member to draw the container tightly against the balusters.

2. A fastening means for attaching containers to the side of balusters on a porch, balcony or stairs, said fastening means comprising:

a first fastening means comprising at least one threaded member that is attached to one side of a container and passes between the balusters when the container is positioned against one side of the balusters;

a second fastening means on an opposite side of the balusters and spanning at least two adjacent balusters, the second fastening means being elongated and having a hole through which the threaded member passes when the container is positioned against the balusters, and the second fastening means cooperates with the first fastening means to draw the container tightly against the balusters;

a knurled knob with a nut that is mounted in the knob and the knurled knob is used to turn the nut onto the threaded member that extends through the elongated second fastening means to draw the container tightly against the balusters; and a support member that is attached to the container and rests on the porch, balcony or stairs having the balusters to which the fastening means is attached to support the weight of the container while the fastening means holds the container against the balusters.

* * * * *